US008331806B2

(12) United States Patent
Wilsher et al.

(10) Patent No.: US 8,331,806 B2
(45) Date of Patent: Dec. 11, 2012

(54) EMPTY BOTTLE DETECTION USING A ONE TIME FOIL SEAL

(75) Inventors: Michael J. Wilsher, Letchworth (GB); James Wood, Ealing (GB); Christopher F. D. Watts, St. Albans (GB); Ben Chaplin, London (GB)

(73) Assignee: Xerox Corporation, Norwalk, CT (US)

( * ) Notice: Subject to any disclaimer, the term of this patent is extended or adjusted under 35 U.S.C. 154(b) by 302 days.

(21) Appl. No.: 12/839,657

(22) Filed: Jul. 20, 2010

(65) Prior Publication Data

US 2012/0020678 A1 Jan. 26, 2012

(51) Int. Cl.
*G03G 15/00* (2006.01)

(52) U.S. Cl. ..... 399/12; 399/106; 399/258

(58) Field of Classification Search ..... 399/12, 399/13, 102–106, 258
See application file for complete search history.

(56) References Cited

U.S. PATENT DOCUMENTS 4,835,568 A 5/1989 Howard et al.
4,963,938 A * 10/1990 Sonoda et al. ..... 399/12
5,216,465 A 6/1993 Arai et al.
6,178,302 B1 * 1/2001 Nagashima et al. ..... 399/106
2001/0030015 A1 * 10/2001 Chadani et al. ..... 156/189
2002/0012546 A1 * 1/2002 Chanadi ..... 399/106
2003/0118355 A1 * 6/2003 Guy et al. ..... 399/12
2004/0228641 A1 * 11/2004 Rommelmann et al. ..... 399/12
2006/0188273 A1 * 8/2006 Takesawa et al. ..... 399/27
2008/0013967 A1 * 1/2008 Masubuchi ..... 399/12

* cited by examiner

*Primary Examiner* — David Gray
*Assistant Examiner* — Tyler Hardman
(74) *Attorney, Agent, or Firm* — Fay Sharpe LLP

(57) ABSTRACT

An image forming apparatus comprises a controller that stores instructions, which cause the image forming apparatus to determine a characteristic measurement in response to a toner cartridge being partially inserted into the image forming apparatus. A pair of spaced apart sensors included on the image forming apparatus each contact an outer cross-sectional surface of a film on a delivery aperture of the toner cartridge. The image forming apparatus further includes an auger having at least one sensor for conducting a characteristic measurement on the film. The characteristic measurement corresponds to criteria programmed in the image forming apparatus for determining if the toner cartridge has a full toner level or a partially full (or low) toner level.

19 Claims, 6 Drawing Sheets

EMPTY BOTTLE DETECTION USING A ONE TIME FOIL SEAL

BACKGROUND

The present application is directed toward a system for detecting a toner cartridge type and, more specifically, to a pair of spaced apart sensors included on an auger of an image forming apparatus that each contacts an outer cross-sectional surface of a film covering a delivery aperture included on a new toner cartridge.

In known methods of print processing, toner particles mix with carrier beads included in a developer station. The mixture is then transferred to a surface portion of a photoreceptor belt. The toner particles are next stripped from the belt surface before they are finally fused onto an image bearing substrate.

It is desirable that the mixture includes predetermined, equal rations of carrier beads to toner particles. A disproportionate ration of carrier beads is indicative of a low level of toner in the cartridge. If an image forming apparatus continues to operate on the low-level of toner, there increases a risk of damaging stations of the apparatus. For example, carrier beads may damage a surface of the sensitive photoreceptor drum. This damage can lead in a long term to image quality defects and more permanent mechanical problems.

A current technique practiced by many operators is a shake-up approach. In an attempt to reinsert the low-level toner cartridge for continued operation, operators remove the cartridge from a main body of the image forming apparatus, shake the cartridge to distribute the remainder of toner volume, and reinsert the cartridge for utilization in additional printing cycles. This technique can lead to a risk of damaging the stations as the machine stresses to operate on pulling air instead of pulling a steady volume of toner.

There is no current system for determining if a cartridge inserted in the image forming apparatus includes a full toner level or a low toner level. It is desirable for a system to distinguish between new (i.e., full toner level) and used (i.e., less than full toner level) cartridges for purposes of extending a life of the image forming apparatus.

An additional risk to stations of the image forming apparatus is presented when counterfeit cartridges are inserted in the apparatus. Generally, the provider of the image forming apparatus similarly provides the replacement cartridges over an overall life of the apparatus. However, the market produces counterfeit cartridges that compete with the recommended cartridge. These counterfeit models tend to be manufactured of a poorer quality, and they have a tendency to pose a risk to a life of the apparatus. There is no current system for determining if a cartridge inserted in the image forming apparatus is a recommended and approved one by the provider, for that apparatus. There henceforth exists a need for an image forming apparatus to prohibit output operations when unauthorized cartridges (under terms of select sales agreements) or unadvised cartridges are inserted into the apparatus.

BRIEF DESCRIPTION

A first exemplary embodiment of the disclosure is directed toward a system comprising a controller that stores instructions and, when executed by an image forming apparatus, causes the image forming apparatus to perform a method including determining a characteristic measurement in response to a toner cartridge being partially inserted into the image forming apparatus. A pair of sensors included on the image forming apparatus each contact an outer cross-sectional surface of a film on a delivery aperture of the toner cartridge.

A second exemplary embodiment of the disclosure is directed toward a system for replacing toner cartridges in an image forming apparatus. The system includes a toner cartridge having a strip layer attached to a delivery aperture of the toner cartridge. The system further includes an auger having at least one sensor for conducting a characteristic measurement on the strip layer. The characteristic measurement determines if the toner cartridge is accepted or rejected by the image forming apparatus for purposes of reinstating print operations.

A third exemplary embodiment of the disclosure is directed toward a toner cartridge including a delivery aperture. A metal seal covers at least a cross-sectional surface portion of the delivery aperture. A resistance of the metal seal corresponds to criteria programmed into an associated image forming apparatus. The resistance determines if the associated image forming apparatus will accept or reject the toner cartridge as having a full level of toner or a low level of toner.

DETAILED DESCRIPTION

The present disclosure is directed toward a strip that extends over a toner aperture of a toner cartridge, which is used for printing actions in an image forming apparatus. The present disclosure is further directed toward a corresponding sensor system situated in the image forming apparatus for purposes of performing monitoring operations on the strip.

Figure 1:
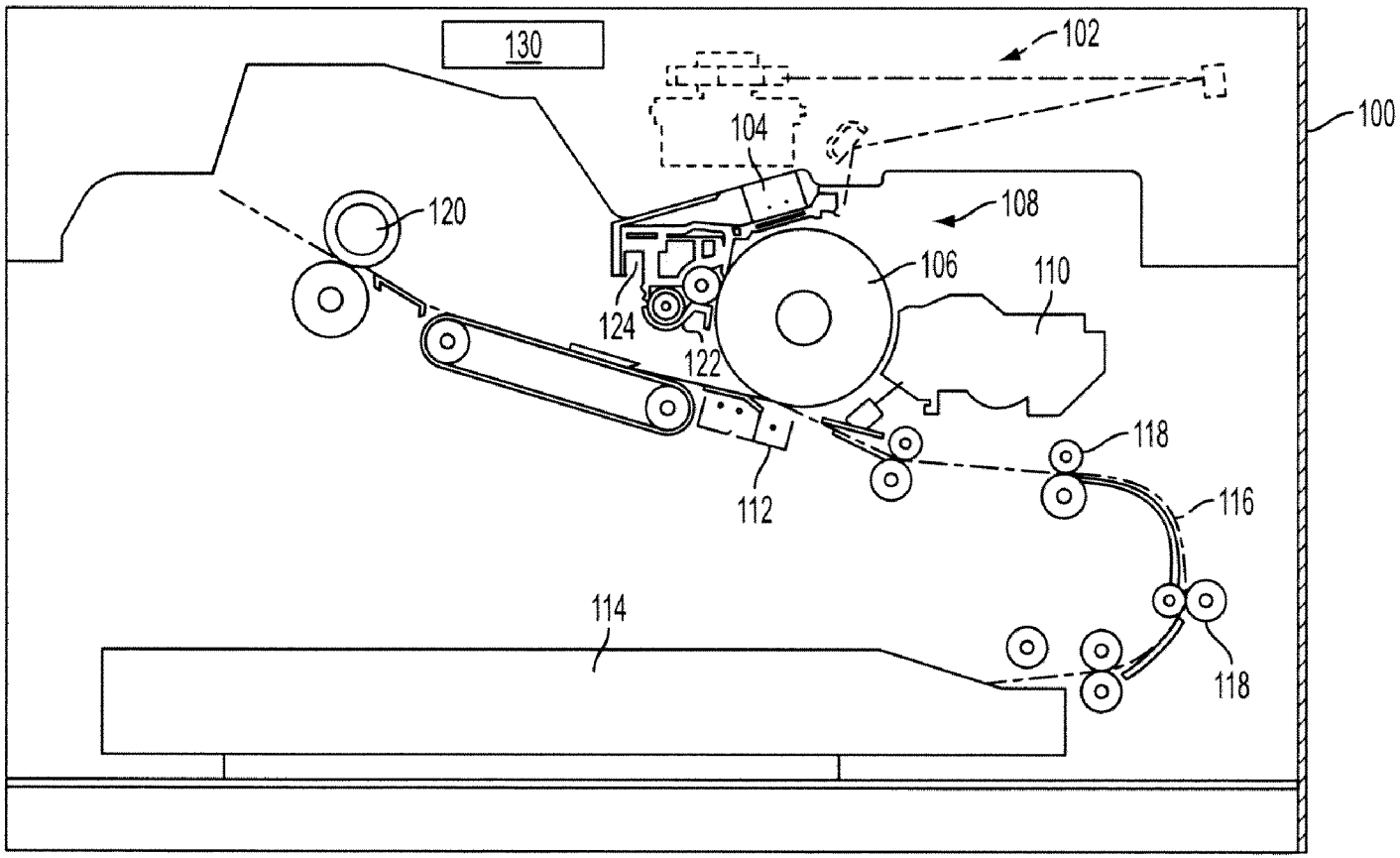
FIG. 1 is a schematic illustration of a toner cartridge incorporated in an image forming apparatus.

FIG. 1 illustrates the present toner cartridge incorporated in an image forming apparatus 100, which herein encompasses any apparatus, such as a digital copier, a bookmaking machine, a facsimile machine, a multifunction machine, and the like, which performs a print outputting operation for any purpose.

FIG. 1 more specifically illustrates a schematic representation of processing stations used in stages of a print cycle, which are sequentially accomplished through the following description. There are anticipated distinctions between various toner cartridge models that can incorporate the present disclosure, but an overall summarization of the process is detailed herein for purposes of understanding a function of the toner cartridge. An original image bearing element is placed on a platen 102 that is electrostatically charged by a charging station 104. A light source, mirrors, and at least one focusing lens expose the image to a photoreceptor 108 (herein synonymously referred to as an "imaging station"). The optical image is selectively discharged from the photoreceptor 108 in an image configuration. More specifically, the imaging station 108 lays an electrostatic latent image of the original image bearing element on a moving belt 106 of the photoreceptor 108. The entire image of the original element is reproduced on a surface of the moving belt 106. A developing station 110 includes a developer device, which develops the electrostatic latent image into visible form. Toner is dispensed into a developer housing, where it mixes with a carrier before being deposited onto the charged photoreceptor belt surface by a developer roll. The developed image is transferred to an image forming substrate at a transfer station 112. More specifically, the image forming substrate is delivered into contact with the belt 106 in synchronous relation to the image from a substrate supply stack stored in a tray 114. A substrate feed mechanism 116 feeds a top sheet of substrate stacked in the tray 114 toward the photoreceptor 108 using roller pairs 118 situated along a feed path. An electric field is provided at the transfer station 112, which includes a corotron for transferring the toner particles onto the image forming substrate. The substrate is stripped from the belt 106 surface, and then it is delivered to a fusing station 120 that fixes the image thereto by an application of heat and pressure. The substrate bearing the copied image is lastly delivered to an output tray (not shown). A brush included in a cleaning station 122 scrapes residual toner particles from the surface of the belt so that it can be used in transferring the next image.

Figure 2:
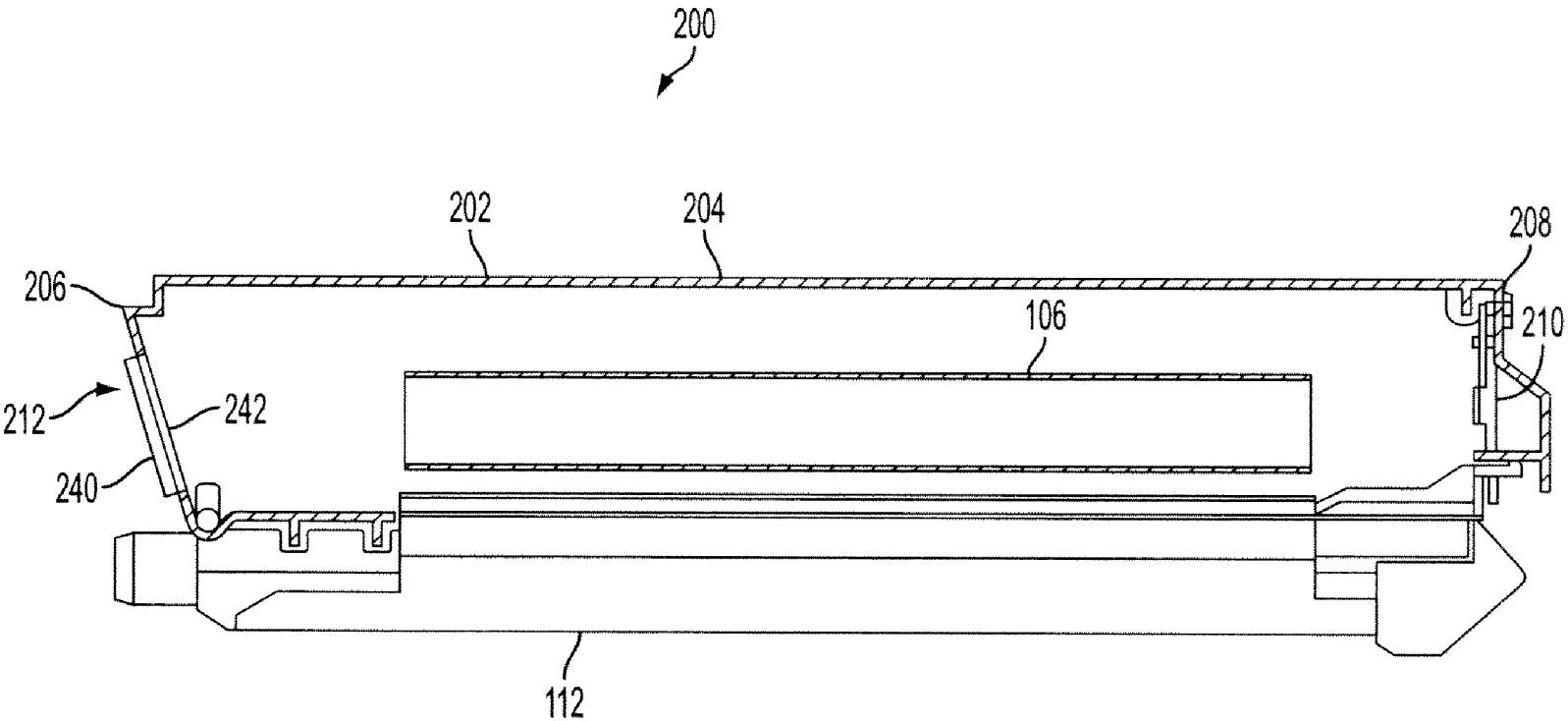
FIG. 2 is a side view of the toner cartridge according to the present disclosure.
Figure 3:
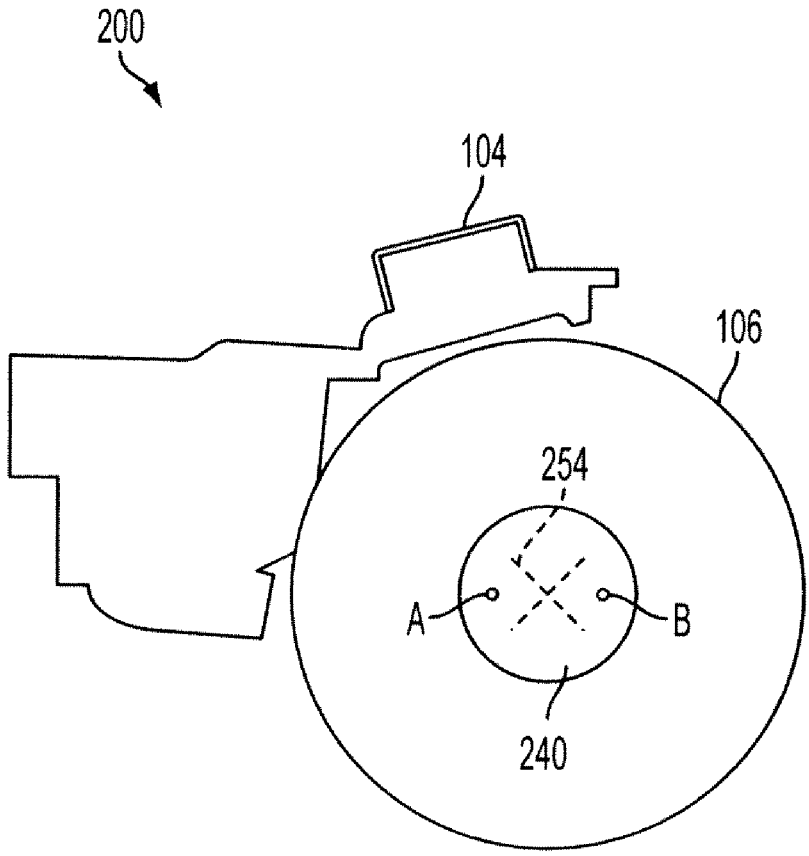
FIG. 3 is a front view of a toner cartridge according to the present disclosure.

The photoreceptor belt 106 (i.e., of the imaging station 108), the transfer station 112, and the cleaning station 122 are incorporated in a removable toner cartridge 200 (hereinafter synonymously referred to as "cassette") that is removeably insertable into a main body of the image forming device 100. A side view of one exemplary cartridge 200 is shown in FIG. 2, and a front view of the cartridge 200 is illustrated in FIG. 3. The toner cartridge 200 is a consumable and/or replaceable housing installed in multifunction copier and/or printer devices to print matter onto various elements. The toner cartridge 200 is illustrated in the figures to include a housing 202 enclosing a containment space. As is illustrated in FIG. 2, the cartridge 200 generally includes an elongate body defined by at least one longitudinally extending sidewall 204 situated between oppositely extending lateral end walls 206, 208. Encased in the housing 202 is the imaging member in the form of the photoreceptor belt 106, the development device, the cleaning device 122, and the charge corotron of the transfer station 112. At a first end wall 208, a latch 210 may be included on the housing 200. A later discussed spigot will actuate the latch mechanism 210 when the toner cartridge 200 is fully inserted in the image processing device 100 (FIG. 1). At the second end wall 206, there is included an aperture 212 for receipt of a later discussed auger.

The toner cartridge 200 mounts onto a dock in the multifunction device 100. A rail 124 (FIG. 1) may be included on the toner cartridge 200 for slideably mounting on corresponding guide rails (not shown) provided on a body of the image forming apparatus 100. The dimensions and model of each toner cartridge 200 can be manufactured specifically for receipt in particular image forming apparatuses. The present disclosure is not limited to any one particular cartridge model; rather, the embodiments taught herein are contemplated for incorporation in a plurality of toner cartridges and multifunction printer systems. Furthermore, features of the embodiments herein may be modified for incorporation in other printer/copier systems, such as, for example, in fluid ink cartridges utilized in ink jet systems.

The toner cartridge 200 includes the aperture 212 situated in a sidewall 206 for egress of powdered toner toward the photoreceptor drum 106. The aperture 212 (hereinafter synonymously referred to as an "opening") is more specifically situated through a lateral wall 206 corresponding to a distal end of the toner cartridge 200 as it is being installed into the image forming apparatus 100. The aperture 212 is illustrated as being formed at a position situated closer to the dispenser and transfer systems when the toner cartridge 200 is rotatably mounted in the image forming apparatus 100.

Figure 4:
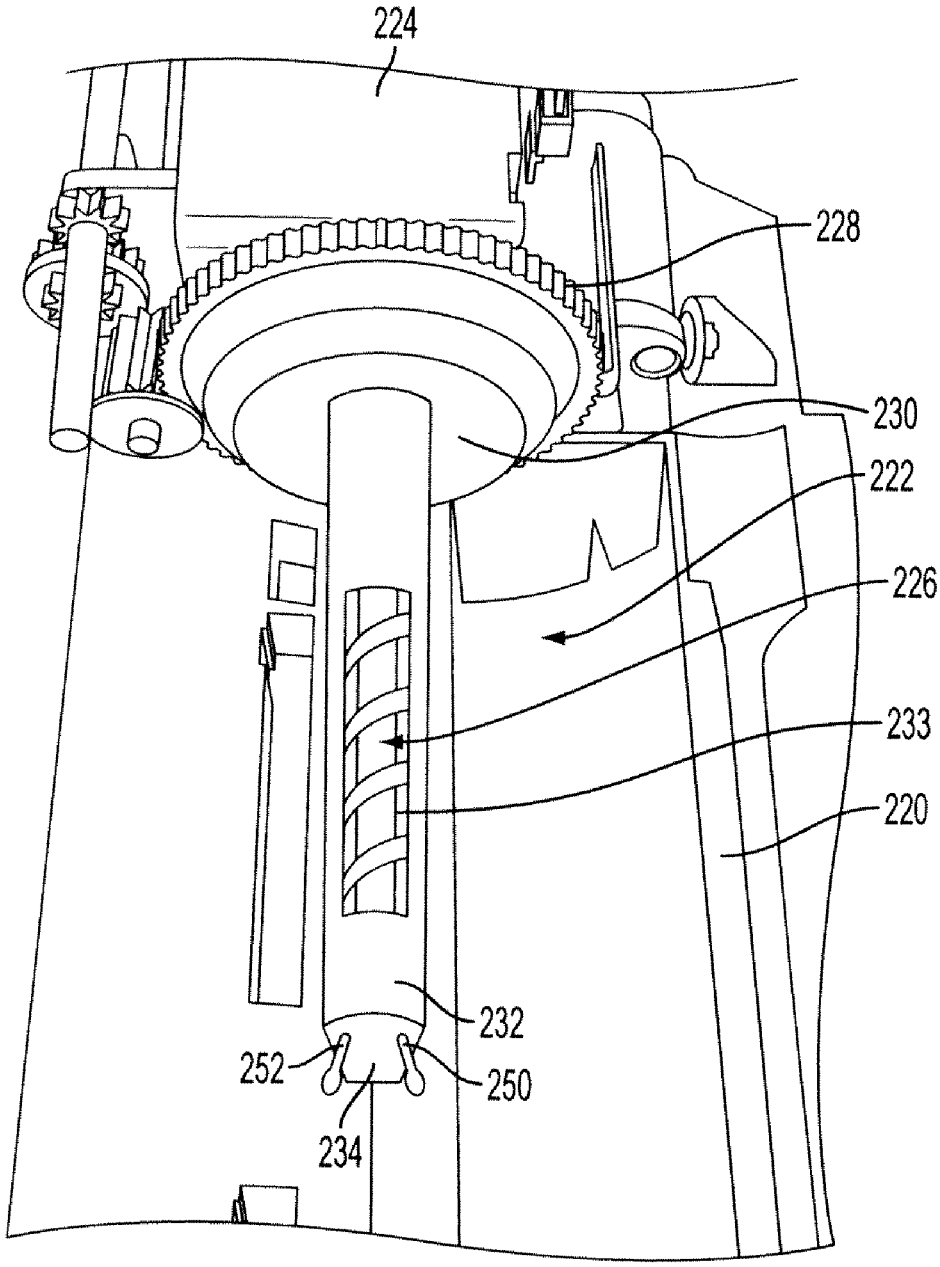
FIG. 4 is a top elevational view of a dispense arrangement including an auger incorporated in the image forming apparatus.

The dock (synonymously referred to as a "platform") is situated internal the image forming apparatus 100 and is accessible by means of a front door panel (not shown). The front door may be manually opened, or it may be alternatively released in response to a command from a controller. The general dock region is illustrated in FIG. 4 to be situated in proximity to an auger 222 extending outwardly from a motor 224. Both the auger 222 and the motor 224 form part of the main body of the image forming apparatus 100. The auger 222 includes a rotating auger screw 226 (synonymously referred to as an auger "bit"), which is rotatably driven by the motor 224. Also attached to the motor 224 is a gear 228 for rotating the toner cartridge 200 once it is solidly mounted onto a support plate 230. The support plate 230 is illustrated as being fixedly connected to an outer oriented face of the gear 228. A stationary spigot 232 (synonymously referred to as a "shroud") similarly extends outwardly from the motor. The stationary spigot 232 extends beyond a terminal end of the auger bit 226. The stationary spigot 232 extends along a longitudinal length of the auger screw 226 and, additionally, surrounds a circumferential surface of the auger screw 226. At least one longitudinally extending aperture 233 is formed through a circumferential length portion of the stationary spigot 232. The longitudinally extending aperture functions to provide contact between the powdered toner and the rotating auger screw 226. A terminal end 234 of the stationary spigot 232 urges against the biased latch mechanism 210 of the toner cartridge when the cartridge is inserted into the image forming apparatus 100.

Figure 5:
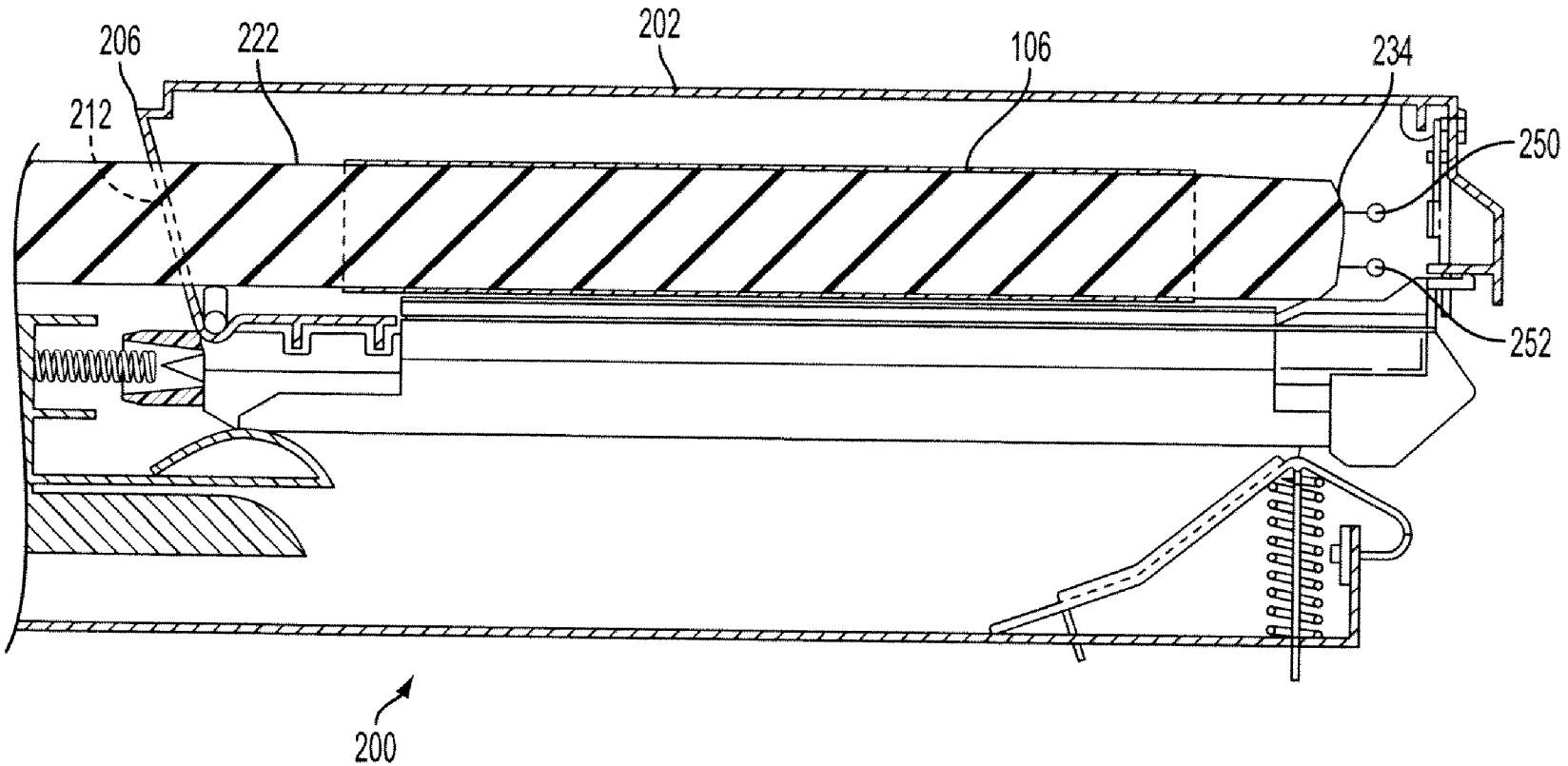
FIG. 5 is a side view of the toner cartridge partially inserted into an operative position in the image forming apparatus; and, FIG. 6 is a flow chart illustrating a system incorporating the present disclosure.

FIG. 5 illustrates the toner cartridge 200 partially inserted into an operative position in the image forming apparatus. As the toner cartridge 200 is inserted into the main body of the image forming apparatus 100, the auger 222 enters the toner cartridge 200 through the aperture 212 in the lateral wall 208 defining the housing 202. The auger 222 threads through the photoreceptor 106.

The present disclosure pertains to the insertion operation. More specifically, the present disclosure is directed toward a system for detecting a fullness level of the toner cartridge 200 such that the internal stations utilized in the print cycle are not negatively affected by attempted reinsertions of relatively low or empty toner cartridges.

Before the toner cartridge 200 is introduced into the image forming apparatus 100, the containment space is completely closed at the aperture 212 by a cover. The aperture 212 is temporarily covered with at least one generally planar protective strip 240 (hereinafter synonymously referred to as a "film" or "seal") (see FIG. 2), which prevents leakage of the powdered toner during manipulation of and installment of the toner cartridge 240. The protective strip 240 is punctured by the stationary spigot 232 during an operational stage when the toner cartridge 200 is slid toward the dock 220 of the image forming apparatus 200. In one embodiment, the strip 240 is formed from a malleable material that easily deforms, bends, or collapses after it is punctured and torn. The malleable material forming the strip 240 collapses inwardly against an inner surface of the housing 204 of the toner cartridge once it is punctured by the stationary spigot 232. In one embodiment, the malleable material may collapse inwardly against in inner wall defining a depth of the aperture 212. In one embodiment, the inner wall (not shown) tapers outwardly so that a fully collapsed film is pushed away from the auger 222.

In one embodiment, the malleable material includes at least one metal. Examples of metals include aluminum, tin, copper, and gold, which are not to be construed herein as limiting. In one embodiment, the protective strip 240 (hereinafter may additionally be referred to as "foil") may be formed adjacent to a foam cap 242 (see FIG. 2) that conventionally covers the aperture 212 of the toner cartridges 200. More specifically, an inner oriented face of the protective strip 240 abuts an outer oriented face of the foam cap 242. In this manner, the terminal end 234 of the spigot 232 comes into first contact with the protective strip 240 before puncturing the foam cap 242. It is furthermore contemplated that other embodiments may include multiple strip and/or foam layers to additionally prevent a risk of leaks. In these embodiments, the protective strip 240 disclosed herein is situated as the outermost layer.

The protective strip 240 is the outermost situated layer because it operates in conjunction with a sensor (hereinafter synonymous to "detection") system for purposes of discriminating against used and/or counterfeit toner cartridges 200. In response to the toner cartridge 200 being partially inserted into the image forming apparatus 100, at least one sensor 250 is included on the image forming apparatus 100 for contacting an outer cross sectional surface portion of the protective strip 240 covering the aperture 212. In the exemplary embodiment, the first sensor 250 is incorporated on the auger 222. More specifically, the first sensor 250 is fixedly connected to the terminal end 234 of the stationary spigot 232. There is no limitation made herein to a means for connecting the sensor system to the spigot 232; rather, such sensor system may be formed integral with the spigot 232 or it may be adhered to, mechanically fastened to, or alternately attached to the spigot. The sensor 250 may be flush with the terminal end of the spigot 232, or it may extend outwardly a distance from the spigot. There is no limitation made herein to a length of an arm connecting the sensor 250 to the auger 222.

It is anticipated that the first sensor 250 is situated at the most forward oriented surface portion of the terminal end 234 of the stationary spigot 232. In this manner, tapered and chamfered terminal ends for contemplated embodiments include the first sensor 250 connected to the surface portion of the spigot 232 that first contacts the protective strip 240.

The first sensor 250 measures at least one characteristic of the metallic protective strip 240. The measured characteristic is associated with a variable indicative of whether the image forming apparatus 100 will accept or reject the toner cartridge 200. In one embodiment, the characteristic is related to at least one property of the metal material forming the protective strip 240. For example, a thickness of the strip may be measured, wherein specific thicknesses are manufactured for particular apparatuses. In another embodiment, the sensor 250 can identify the metal material included in the strip based on one property of the metal. In this manner, the sensor 250 can identify if the strip 240 is formed from a tin, gold, aluminum, or an alternate or combination material. Specific cartridges for distribution are manufactured with unique strips 240 for insertion into particular apparatuses based, for example, on recommendations and later discussed categories.

The measurement, or a subsequent variable computed from the measurement, is compared to a predetermined threshold value. In the exemplary embodiment, the sensor system further includes at least a second sensor 252 spaced apart from the first sensor 250. The second sensor 252 is similarly situated on a terminal end of the stationary spigot 232. The second sensor 252 is spaced apart from the first sensor 250 at a distance that is less than a diameter of the strip 242. The second sensor 252 operates with the first sensor 250 to measure a characteristic. In one embodiment, the pair of sensors 250, 252 function similar to a multimeter to measure a resistance of the metal material forming the protective strip 240. In one embodiment, this resistance measurement is utilized as a variable input in a computation to calculate at least one of a voltage or a current measurement. A controller 130 (FIG. 1) is operatively associated with the pair of sensors 250, 252 to perform the computation based on an algorithm stored in a memory. In one embodiment, this controller 130 is included in the image forming apparatus 100, whereupon it is operatively associated with the various processing stations of the apparatus. More specifically, the controller 130 controls the processing stations based on the transmitted or subsequently calculated measurement (hereinafter referred together as the "characteristic measurement"). The controller includes at least one predetermined threshold or threshold range (which may be included in a look-up table) to base a determination on initiating, continuing, and suspending/terminating operations of select or all processing stations.

In one embodiment, current is traveling to at least the first sensor 250. The pair of sensors 250, 252 are able to transmit a characteristic measurement to the controller 130 during instances when the current can freely flow between (i.e., from) the first sensor 250 and (i.e., to) the second sensor 252. In this manner, the circuit must be complete. The metal film forming the strip 240 completes a circuit between the pair of sensors 250, 252 contacting it when a cross-sectional surface portion of the metal form is continuous. In one embodiment, the cross-sectional surface portion includes an area covering the entire aperture 212. In another embodiment, the cross-sectional surface portion may include an area covering a particular section of the aperture 212. However, based on a select positioning and a distance between the sensors 250, 252, the circuit is not complete when the cross-sectional area portion is non-continuous.

The sensors 250, 252 are situated on the spigot 232 of the auger 222 at select positions corresponding to points on the strip 240 that are likely to be included on separate(d) strip portions A, B when the strip is punctured. These separate strip portions may be included on opposite sides of a linear perforation 254 formed on the strip 240 to assist in breakage after the auger 222 punctures the strip 240. In one embodiment, a pair of diagonally intersecting perforations 254 (see FIG. 3) can form a cross-cut impression in the strip 240 that divides it into separable segments. The first sensor 250 may be positioned on the auger 222 to contact a position A on the strip 240 coincident with a first (triangular-shaped) segment portion and the second sensor 252 may be formed in the auger to contact a second position B on the strip coincident with an opposite (triangular-shaped) segment portion (see FIG. 3). In another embodiment, the first sensor 250 may be positioned on the auger 222 to contact a position on the strip 240 coincident with the first segment portion and the second sensor 252 may be formed to contact an adjacent segment portion. There is no limitation made herein to the cross-sectional surface portion of the strip 240 that the sensors 250, 252 respectively contact. A limitation is made herein, however, that the surface portions are able to separate from one another upon a forward urging of the auger 222 to disrupt current flow through the circuit.

More specifically, puncturing or tearing of the strip 240 by the auger 222 causes the circuit to be interrupted between the sensors 250, 252 because the cross-sectional surface portion of strip material between the sensors becomes non-continuous. Therefore, it is only during instances when the protective strip 240 is fully intact that a characteristic measurement may be taken and transmitted to the controller 130.

The controller 130 compares the characteristic measurement to at least one predetermined threshold value, which is programmed as being specific to cartridge type recommendations for (extending a life of) the particular image forming apparatus 100. Therefore, the controller 130 is programmed to reject the toner cartridge 200 if the predetermined threshold is not met. In one embodiment, the controller 130 rejects the controller cartridge 200 by not activating the processing stations for purposes of instituting the printing cycle. In another embodiment, the controller 130 can alternatively or additionally display on an operator interface (situated on or remotely communicating with the image forming apparatus) that the toner cartridge 200 not accepted. The display action includes, for example, any type of visual, audio, or other communication to a human user, at any time, through any device. In the latter embodiment, the operator is informed that the print cycle will not institute with further insertion of the toner cartridge 200.

To clarify, the controller 130 is programmed to reject a toner cartridge 200 when the sensors 250, 252 cannot transmit a characteristic measurement due to an incomplete circuit caused by a non-continuous protective strip 240. This rejection occurs in instances when a used toner cartridge 200 is (attempted) reinsertion into the image forming apparatus 100. The apparatus 100 fails to detect a presence of the strip 240, thus indicating that a cartridge 200 is being inserted having less than a full level of toner.

For these used toner cartridges, a presence of the protective strip 240 provides at least two functions: (1) it verifies a full level of toner in the cartridge 200; and, (2) it prevents a risk of strain to internal stations of the image forming apparatus 100. However, even after a positive detection of a new toner cartridge, the controller 130 can reject the full toner cartridge model as not qualifying for a recommended insertion in the apparatus based on particular programmed standards unique to the apparatus.

As previously described, the characteristic measurement corresponds to criteria programmed in the image forming apparatus 100. For example, a resistance measurement can correspond in certain embodiments to a thickness of the protective film 240. In other embodiments, the resistance measurement is related to the type of metal material included in the film 240. The controller 130 uses thresholds to identify the toner cartridge type and/or model based on the film 240 covering the aperture 212 of the particular toner cartridge 200. In the industry for apparatuses that form images on substrates, individual relationships are created between an apparatus provider and a client. This relationship (as opposed to the apparatus) is the basis for a majority portion of profits generated for the provider. For example, the relationship may include a purchase agreement made between the parties for the client to acquire full ownership of the apparatus. An alternative relationship may include a lease agreement made between the parties for the client to lease the apparatus for a term. In the latter relationship, the client is often under an obligation to purchase replacement toner cartridges 200 from the provider of the apparatus. Because the toner cartridges 200 are consumable, replacements form a large basis for profit to the provider. Additionally, because the provider will retain ownership of the (leased) apparatus, it has an interest in maintaining a life of the apparatus. However, there are often counterfeit substitutes available in the market. In some instances, the counterfeit substitute cartridges can damage the apparatus if their manufacture is of lesser quality.

The characteristic measurement accomplished by the present disclosure provides a system for the controller 130 of the image forming apparatus 100 to distinguish qualifying from generic replacement toner cartridges 200. Namely, parameters can be programmed into a controller 130 operating an image forming apparatus 100 based on recommendations and/or the sales agreement, and the image forming apparatus 100 can reject (i.e., suspend print processing) when a counterfeit replacement toner cartridge is attempted for insertion into the apparatus. The parameters determine the threshold levels of which the controller 130 compares the characteristic measurements to.

In another example, a parameter or criteria programmed into the controller 130 of particular image forming apparatuses may include restrictions on the type of (e.g., colored) toners, and henceforth toner cartridges 200, placed in the image forming apparatus 100. Reception of particular toner cartridge types can be limited based on the machine type and other parameters, wherein each parameter corresponds to a select characteristic measurement. At the manufacturing of the toner cartridges 200, the protective strip 240 is placed on the aperture 212 for purposes of enforcing an insertion of the cartridges in the proper apparatuses.

Once the controller 130 indicates that the toner cartridge 200 is accepted, i.e., when the circuit is complete or the predetermined measurement threshold is met, forward urging of the toner cartridge 200 is continued to complete a full insertion in the image forming apparatus. In the instance when the toner cartridge 200 is a new replacement (i.e., having a complete fullness level), the auger 222 punctures and tears the film 240 to interrupt the circuit so that current can no longer freely flow between the pair of sensors 250, 252. The controller 130 identifies a change in a status of the circuit, from being complete to incomplete, and responds by instituting printing output of queued or future printing cycles. The controller will continue printing cycles until either (i) the toner volume depletes to a low level or (ii) the toner cartridge 200 is manually moved away from its fully inserted position in the image forming apparatus 100.

As articulated above, the first and second sensors 250, 252 determine if current flows through a circuit and positive current flow is indicative that the toner cartridge is at full volume.

Figure 6:
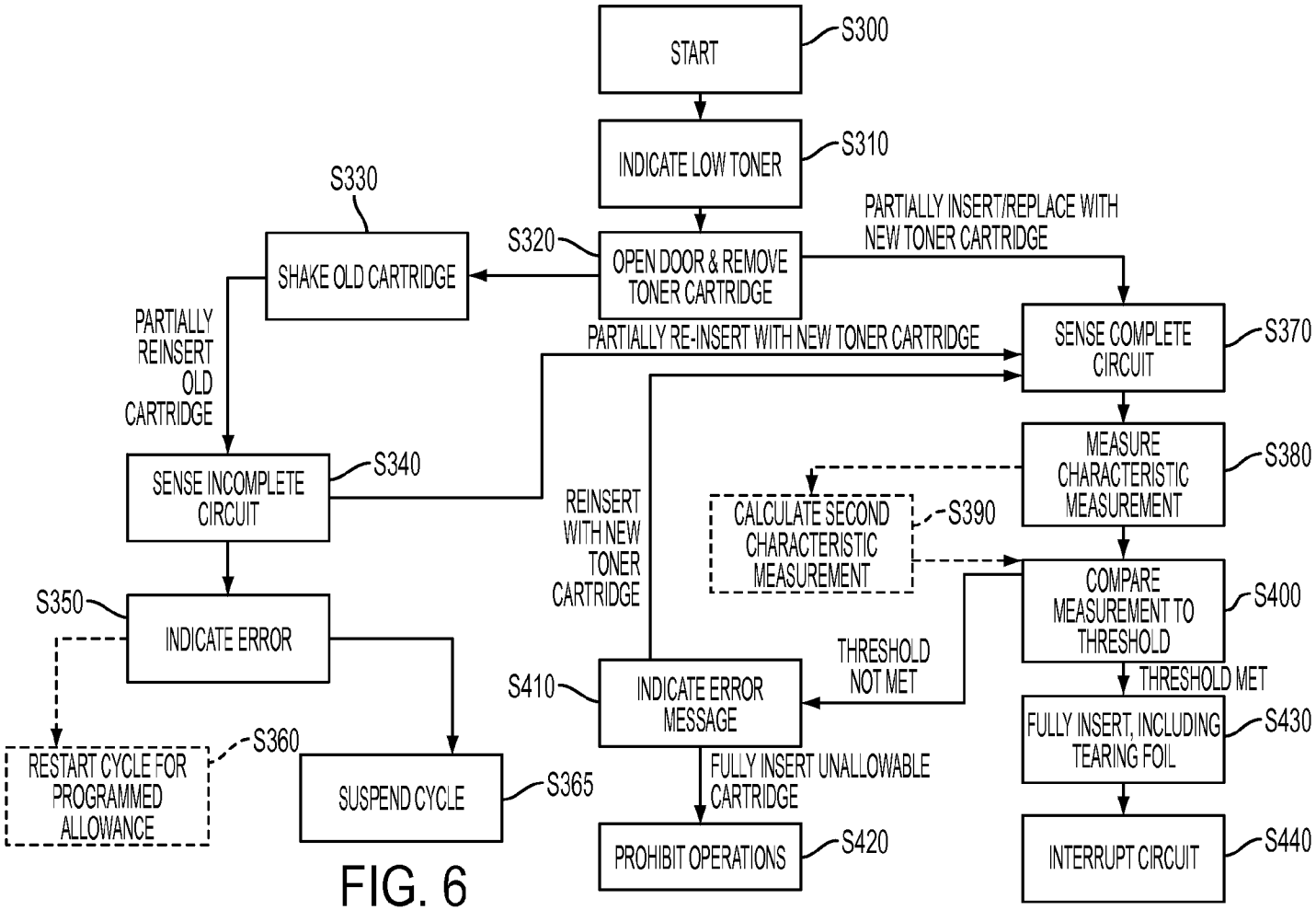

FIG. 6 illustrates a flow chart of one exemplary system incorporating the present disclosure. A computer-usable data carrier stores instructions that cause the image forming apparatus to perform the actions. The series of actions are programmed into the image forming apparatus or in a controller operatively associated with the apparatus. The program may be instituted for any printer or copier apparatus capable of housing a consumable toner cartridge body. The sequence of actions initiate at start S300. An indication system indicates a low toner level S310 by utilizing a conventional detector. A front panel on the image forming apparatus opens S320 so that an operator can gain access to the low-level toner cartridge. The operator removes the low-level toner cartridge (hereinafter referred to as the "old cartridge"). It is known that operators will attempt to obtain additional print cycles using the old cartridge. These operators typically shake up S330 the cartridge and (partially or fully) reinsert it into the image forming apparatus. As a first option, the operator reinserts the old cartridge after it is shaken. The sensors (250, 252) situated on the auger fail to make contact (and henceforth detect presence) with a strip (240) since there is no such cover over the previously exposed aperture. Therefore, the sensors fail to detect any current movement, and the sensors detect an incomplete circuit S340. The sensors transmit this information to the controller (130), which recognizes the reading as not satisfying a parameter for a new cartridge. Therefore, the controller indicates an error S350, which may be indicated by a visible or an audio display. Alternatively, the error is concluded when the print cycle fails to restart. In one embodiment, the controller may be programmed to recognize reinsertion of an old cartridge one time without preventing output operations. Rather, the controller is programmed to restart S360 the cycle for an allowance of one shake-up of the toner cartridge in an attempt to utilize the remainder low level of toner contained in the cartridge. The device is programmed to allow a run of one additional cycle to provide for the consumer shake-ups, but the controller stores the run in a memory. In this manner, the apparatus is programmed to not permit, for example, two reinsertions of old cartridges in a row.

Alternatively, in one embodiment the controller is programmed to not accept any old toner bottles in any circumstance. In either instance, the controller will suspend any printing S365 of output until a replacement toner cartridge is sensed as being installed including a full toner level.

A replacement toner cartridge having a full-level of toner (hereinafter referred to a "new cartridge") is partially inserted into the image forming apparatus so that the sensor system disclosed herein has an opportunity to make a determination. The sensors situated on the shroud of the auger contact the strip covering the aperture of a new cartridge. Once the sensors contact the strip, current flows freely between the spaced apart sensors. The current flow is sensed S370 as moving through a complete circuit. At least one sensor takes a characteristic measurement S380 and transmits the measurement to the controller. One example of a characteristic measurement includes a resistance level of the material forming the strip layer. The controller may use the characteristic measurement as a variable in a computation for calculating a second characteristic measurement S390. For example, the resistance measurement can be used to compute a voltage measurement or a current level measurement. The values of the measurements correspond to specific strip layers that are associated with particular cartridge types recommended as insertable into select apparatuses. The controller compares the characteristic measurement to a predetermined threshold S400. The controller may compare the characteristic measurement to at least one predetermined threshold range. The results of the comparison determine, for example, whether the cartridge satisfies the replacement cartridge type approved under terms of the sales agreement. Strips have determined resistance characteristics before they are placed over the aperture during manufacturing. In this manner, breaches of the sales agreement cannot be directly tracked; however, the terms of the sales agreement can be enforced when the controller does not recognize a characteristic measurement within programmed allowable ranges. If the threshold is not met (indicative, e.g., of an unapproved, unrecommended, or a counterfeit cartridge), the controller indicates an error S410. If the operator continues to fully insert the toner cartridge, the controller will operate to prohibit activation of print cycling S420.

If the characteristic measurement meets the threshold value, an indication guides the operator into completing a full insertion of the toner cartridge S430. As the toner cartridge is pushed toward the auger, the strip layer tears. This tear interrupts the circuit S440, and the new cartridge is deemed for future reinsertions as a used toner cartridge.

Although the control method S300 is illustrated and described above in the form of a series of acts or events, it will be appreciated that the various methods or processes of the present disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods and other methods of the disclosure may be implemented in hardware, software, or combinations thereof, in order to provide the control functionality described herein, and may be employed in any system including, but not limited to, the above illustrated system, wherein the disclosure is not limited to the specific applications and embodiments illustrated and described herein.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for determining a fullness level in a toner cartridge, the method comprising:

at least partially receiving at the image forming apparatus a toner cartridge including a film attached to a delivery aperture of the toner cartridge;

conducting, by a pair of sensors situated on an auger of the image forming apparatus, a characteristic measurement of the film, the characteristic measurement being indicative of a toner level; and controlling, by a controller operatively associated with the pair of sensors, at least one processing station of the image forming apparatus based on the characteristic measurement.

2. The method of claim 1, wherein the film completes a circuit between the pair of sensors when the cross-sectional surface is continuous.

3. The method of claim 1, wherein the film interrupts a circuit between the pair of sensors when the cross-sectional surface is non-continuous.

4. The method of claim 1, wherein the film is formed from a malleable metal.

5. The method of claim 2, further comprising:

determining one of a voltage and current measurement of the complete circuit.

6. The method of claim 5, further comprising:

comparing the voltage or the current measurement to a predetermined threshold.

7. The method of claim 6, further comprising:

indicating that the toner cartridge is not accepted when the threshold is not met.

8. The method of claim 6, further comprising:

indicating that the toner cartridge is accepted when the threshold is met;

tearing the film by an auger; and, instituting a printing cycle.

9. The method of claim 1, further comprising:

indicating that the toner cartridge is not accepted when the cross-sectional surface of the film is non-continuous.

10. A system for replacing toner cartridges in an image forming apparatus, comprising:

a toner cartridge including a strip layer attached to a delivery aperture of the toner cartridge; and, an auger including at least one sensor for conducting a characteristic measurement on the strip layer, wherein the characteristic measurement determines if the toner cartridge is accepted or rejected by the image forming apparatus.

11. The system of claim 10, wherein the strip layer is formed from a malleable metal material.

12. The system of claim 11, wherein the sensor measures a resistance characteristic of the metal material.

13. The system of claim 12, wherein the resistance characteristic of the metal material is indicative of whether a controller of the image forming apparatus will accept or reject the toner cartridge by comparing the resistance to a predetermined threshold.

14. The system of claim 10, further including a second sensor spaced apart from the first sensor, wherein the first and the second sensor determine if current is flowing through a circuit.

15. The system of claim 14, wherein the at least one and second sensors are situated on a terminal end portion on a stationary spigot of the auger.

16. The system of claim 14, wherein a current flow is indicative that the toner cartridge is full and no current flow is indicative that the toner cartridge is partially full or empty.

17. A toner cartridge comprising:

a delivery aperture; and, a metal seal covering at least a cross-sectional surface portion of the delivery aperture, the metal seal including:

a resistance corresponding to criteria programmed into an associated image forming apparatus, wherein the resistance determines if the associated image forming apparatus accepts or rejects the toner cartridge as having a full-level of toner or a low-level of toner; and, a cross-cut perforation for assisting in a break of the metal seal.

18. The toner cartridge of claim 17, wherein the metal seal being continuous at a preselected cross-sectional surface region of the delivery aperture is indicative of the toner cartridge being full, and the metal seal being non-continuous at the preselected cross-sectional surface region of the delivery aperture is indicative of the toner cartridge being partially full or empty.

19. The toner cartridge of claim 18, wherein the preselected cross-sectional surface region forms part of a circuit when the toner cartridge is mounted into the associated image forming apparatus, wherein a current flows through the circuit when the preselected cross-sectional area is continuous and the current does not flow through the circuit when the preselected cross-sectional area is non-continuous.

* * * * *